United States Patent [19]

Eull

[11] 4,165,836

[45] Aug. 28, 1979

[54] ROTATABLE SPRAY NOZZLE WITH SAFETY GUARD

[75] Inventor: Marvin J. Eull, St. Michael, Minn.

[73] Assignee: Graco Inc., Minneapolis, Minn.

[21] Appl. No.: 866,360

[22] Filed: Jan. 3, 1978

[51] Int. Cl.[2] ..... B05B 15/02

[52] U.S. Cl. ..... 239/119; 239/288

[58] Field of Search ..... 239/119, 288.5, 288.3, 239/288, 600, 499, 521, 522, 523, DIG. 14, DIG. 22; 137/379, 377

[56] References Cited

U.S. PATENT DOCUMENTS

| | | | |
|---|---|---|---|
| 3,955,763 | 5/1976 | Pyle et al. | 239/119 |
| 4,116,386 | 9/1978 | Calder | 239/288 |

*Primary Examiner*—James B. Marbert

*Attorney, Agent, or Firm*—Paul L. Sjoquist

[57] ABSTRACT

Apparatus for attachment to a hand operated spray gun, comprising a cylindrical rotatable member having a spray orifice therein, which is rotatable between a spraying position and an orifice cleaning position, the rotatable cylindrical member having a metallic sealing member surface of matching shape and adjacent thereto, and a further resilient sealing member for permitting leakproof attachment to a spray device. The rotatable spray member is actuably coupled to a safety tip guard so as to become disassembled if the safety tip guard is removed.

20 Claims, 4 Drawing Figures

ROTATABLE SPRAY NOZZLE WITH SAFETY GUARD

BACKGROUND OF THE INVENTION

This invention relates to a rotatable spray nozzle apparatus for attachment to a spray gun wherein the rotatable spray nozzle is sealably connected to the spray fluid passage, and is integrally supported by a safety tip guard. If the safety tip guard is removed the rotatable spray nozzle becomes disassembled.

U.S. Pat. No. 3,952,955, issued Dec. 12, 1974, and entitled "Safety Tip Guard" discloses a safety guard for protection against accidental contact of high pressure liquid by the human body. The patent discloses a fan-shaped safety guard which is attachable to the end of a spray gun by means of a spring clip connection so as to accommodate the shape of spray patterns currently being used by state of the art spray guns without inhibiting the spray gun utility for spraying articles to be coated. The forwardly projecting ears of the device disclosed in this patent are separated by a narrow slotted region opening near the spray tip. This safety guard is typically used in spraying paint under high hydraulic fluid pressures.

U.S. Pat. No. 3,955,763, issued May 11, 1976, and entitled "Rotatable Spray Nozzle" discloses an apparatus for attachment to a spray gun comprising a rotatable ball member having a spray orifice in a diametric passage and a handle formed as an integral part thereof. The patent also discloses a housing for enclosing the ball member while allowing the handle portion to project external of the housing, and a sealing member for fitting into the housing in sealing contact with the ball member, and a threadable attachment for securing the housing and ball and sealing members to a spray gun so that the ball member may be rotatably moved to place the spray orifice in either a spraying position or in a cleaning position with respect to the spray gun.

The principal problem which must be overcome in the design of a rotatable spray nozzle, where high hydraulic pressures are encountered, is to provide an adequate sealing means which will prevent fluid leakage, especially after repeated rotations of the spray nozzle and periodic instances of breaking the seal connection because of removal of the nozzle from the spray gun for cleaning or other purposes. It has often been necessary to provide a clamping means which holds the rotatable spray nozzle against the spray gun under very high clamping forces in order to prevent fluid leakage around the rotatable spray nozzle. The clamping forces necessary for sealing have frequently been high enough to inhibit the rotatability of the spray nozzle, and further, to prematurely damage the internal sealing components. A secondary problem which must be overcome or safeguarded against whenever high hydraulic pressure fluids are sprayed is to provide adequate protection from human contact with the spray fluid, at least over a relatively short distance in front of the spray orifice. Spray particles emitting from the spray orifice are for a brief distance arranged in the form of a high-velocity sheet of liquid, which sheet quickly breaks up in the atmospheric environment to create finely atomized particles. The foregoing U.S. Pat. No. 3,955,763, discloses an apparatus directed at the problem of providing an adequate sealing means, and the foregoing U.S. Pat. No. 3,952,955, discloses an apparatus directed at the problem of avoiding human contact with the vicinity immediately in front of the spray orifice. The present invention in part comprises an improved combination of the two foregoing patents, and in part comprises an improvement over each of them.

SUMMARY OF THE INVENTION

The present invention comprises a rotatable spray nozzle having a cylindrical rotatable member and a novel sealing means to prevent leakage of high pressure fluid, which sealing means incorporates a metallic bearing member against the rotatable member and a spaced, resilient member clamped between the metallic bearing member and the spray gun to provide a fluid seal and at the same time cushion the metallic bearing member from excess clamping forces. It also comprises a safety guard which forms an integral part of the nozzle rotation mechanism, so that intentional removal of the safety guard will prevent operable assembly of the rotatable nozzle, thereby ensuring that the safety guard be retained on the spray gun for the operator protection which it provides.

BRIEF DESCRIPTION OF THE DRAWINGS

A preferred embodiment of the invention is shown in the appended drawings, in which.

DESCRIPTION OF THE PREFERRED EMBODIMENT

Figure 1:
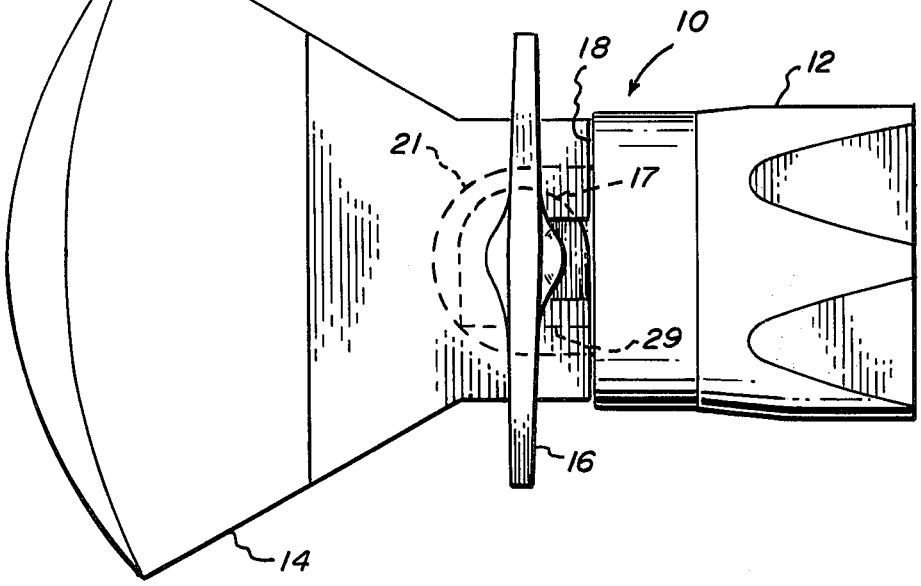
FIG. 1 illustrates a plan view of the apparatus.

Referring first to FIG. 1, spray nozzle 10 is shown in plan view, having a spray tip nut 12 attached thereto and a safety guard 14 projecting therefrom. A rotatable handle member 16 is held in position on spray nozzle 10 by the end portion of safety guard 14. An internal arcuate slot 21 on safety guard 14 provides a channel within which a shoulder 17 on handle member 16 may turn. Shoulder 17 is positioned adjacent the front flange 18 of spray tip nut 12, and has a partially rounded shape to permit rotational freedom of movement of handle member 16 against the front flange 18 of spray tip nut 12. Shoulder 17 has a flat edge 29 which prevents complete rotational movement of handle member 16 against the front flange 18 of spray tip nut 12.

Figure 2:
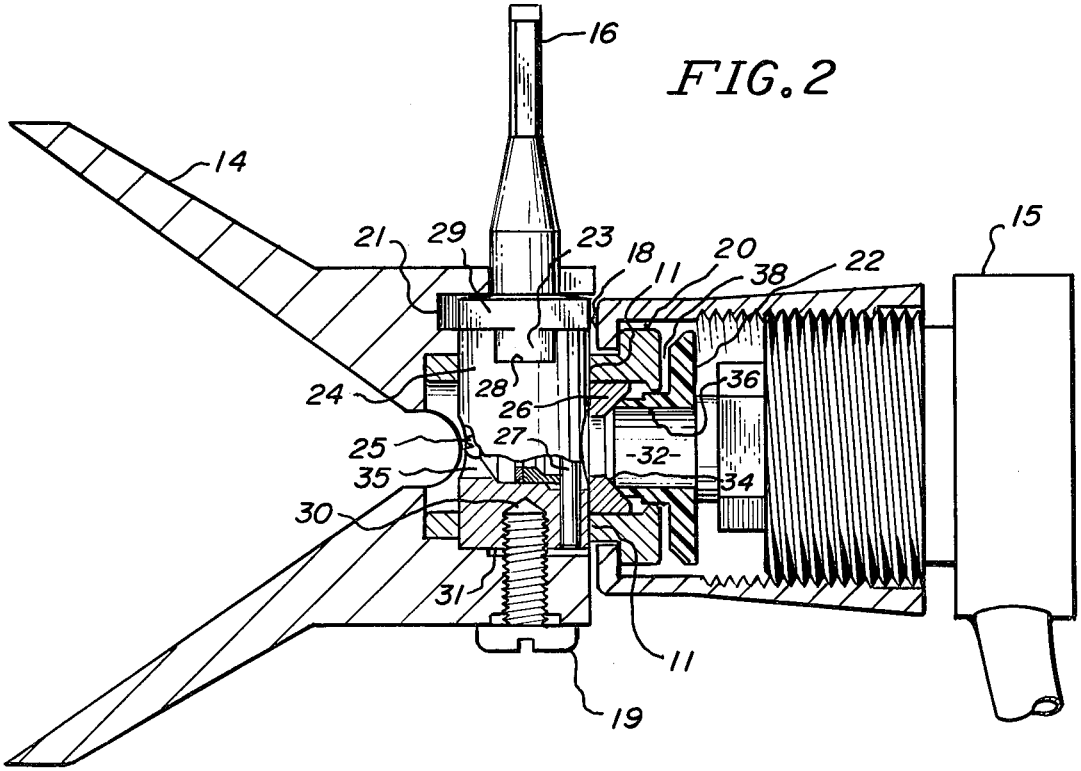
FIG. 2 shows a bottom view in partial cross section.

FIG. 2 shows a bottom view of the apparatus of FIG. 1, illustrating tip nut 12 threadably attached to a spray gun body 15. Tip nut 12 has a front flange 18 which clamps against a similar flange on housing 20. A resilient sealing member 22 is threadably clamped between housing 20 and spray gun body 15 to provide a fluid seal for the attachment of spray nozzle 10 to the spray gun body 15.

A transverse passage 11 through housing 20 is sized to accept cylindrical rotatable member 24. Cylindrical member 24 has a grooved end surface 28 for accepting a mating projection 23 on the end of handle member 16, and a second end surface 31 having a locating hole 30 for receiving the end of a bolt or pin 19 which is threaded through safety guard 14. An axial passage 32 is formed through housing 20, and cylindrical member 24 has a similar diametric passage 35 therethrough which is held in alignment with passage 32. At one end of the diametric passage 35 through cylindrical member 24 is rigidly attached a spray tip 25. At the other end of the diametric passage 35 is rigidly attached a deflector pin 27. A metallic sealing member 26 is shaped to closely fit against the exterior surface of cylindrical member 24, and is held in place by resilient sealing member 22. The surface of sealing member 26 which contacts cylinder 24 is machined to have the same curvature as cylinder 24 for closely fitting thereto. The opposite surface of member 26 has a conical flange 34 for accepting the mating end of resilient sealing member 22. Resilient sealing member 22 has a neck 36 which is longer than the internal distance from conical flange 34 to the rear edge of housing 20 so as to provide a small gap 38 between housing 20 and the shoulder portion of sealing member 22. Gap 38 becomes closed when spray tip nut 12 is tightened to clamp spray nozzle 10 against spray gun body 15, which clamping action forces the mating end of neck 36 into tight sealing contact against conical flange 34. Furthermore, the high fluid pressure in passage 32 tends to force resilient sealing member 22 outwardly against flange 34 and thereby increases the liquid seal formed between these two members. Fluid pressure in passage 32 also creates pressure forces acting on flange 34 to force sealing member 26 into a tight liquid seal against cylinder 24.

Sealing member 26 is preferably formed from a metallic material somewhat softer than the material used to make cylindrical member 24. The use of such dissimilar materials will permit the surface of sealing member 26 which is mated against cylindrical member 24 to wear in and effectuate a very close fit and liquid seal. Further, as indicated above, resilient sealing member 22 has a forward end bevel which is received by a conical seat in one side of sealing member 26. The hydraulic fluid pressures within axial passage 32 will act upon the exposed inner surface area of resilient sealing member 22 and sealing member 26 so as to enhance the sealing bond between them, and so the interactive shapes of these two members actually improve the fluid seal between them, and the same internal pressure forces cause sealing member 26 to be tightly held against cylindrical member 24. Because the internal fluid pressure forces in passage 32 actually assist in improving the sealing function of the respective members 22, 24 and 26, there is a lesser mechanical tightening force required from tip nut 12. Further, the mechanical forces holding sealing member 26 in place against cylindrical member 24 are cushioned by the intermediate position of resilient sealing member 22. The net result and improvement of this construction is to create less wear on metallic sealing member 26 and cylindrical member 24, and to permit easier rotation of cylindrical member 26 for a given fluid sealing capability.

Handle 16 has an upper end for grasping and a lower end having a projection 23 for engaging into groove 28 on the end surface of cylindrical member 24. As described previously, shoulder 17 is positioned adjacent the end surface of cylindrical member 24, said shoulder 17 riding within a slot 21 in safety guard 14. Shoulder 17 is rounded over 180° so as to permit limited rotational turning of handle 16, but has a flat side 29 which prevents full rotational movement of handle 16. Thus, shoulder 17 permits handle 16 to be rotated over a limited range of 180°.

Figure 3:
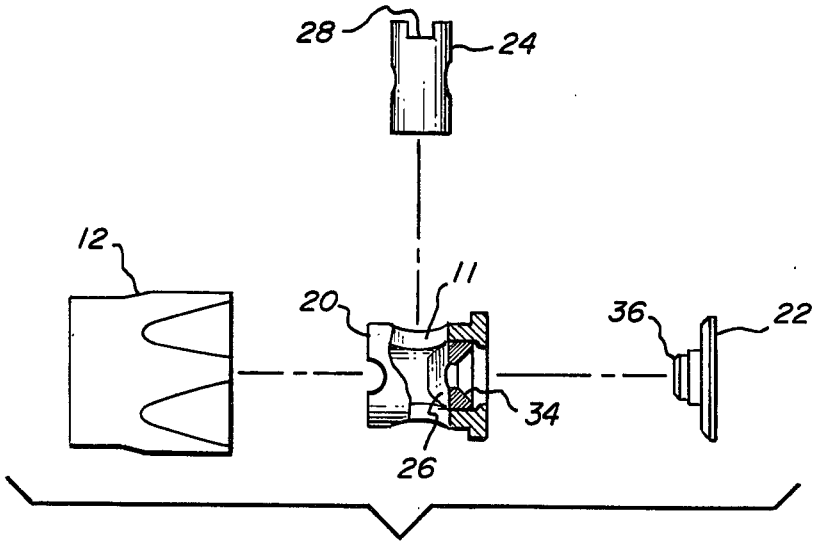
FIG. 3 shows an exploded view of the invention components.

FIG. 3 illustrates an exploded view of some of the components of the nozzle 10, and shows the assembly arrangement. Tip nut 12 is fitted over one end of housing 20, and metallic sealing member 26 is inserted from the front end of passage 32 in housing 20 and is aligned with transverse passage 11 in housing 20. Resilient sealing member 22 is then inserted into the rear end of passage 32 in housing 20. Tip nut 12 is then fitted over housing 20 and moved back so as to contact flange 18 against the housing 20 rear flange. Cylindrical member 24 is then inserted through the transverse passage 11 in housing 20.

Figure 4:
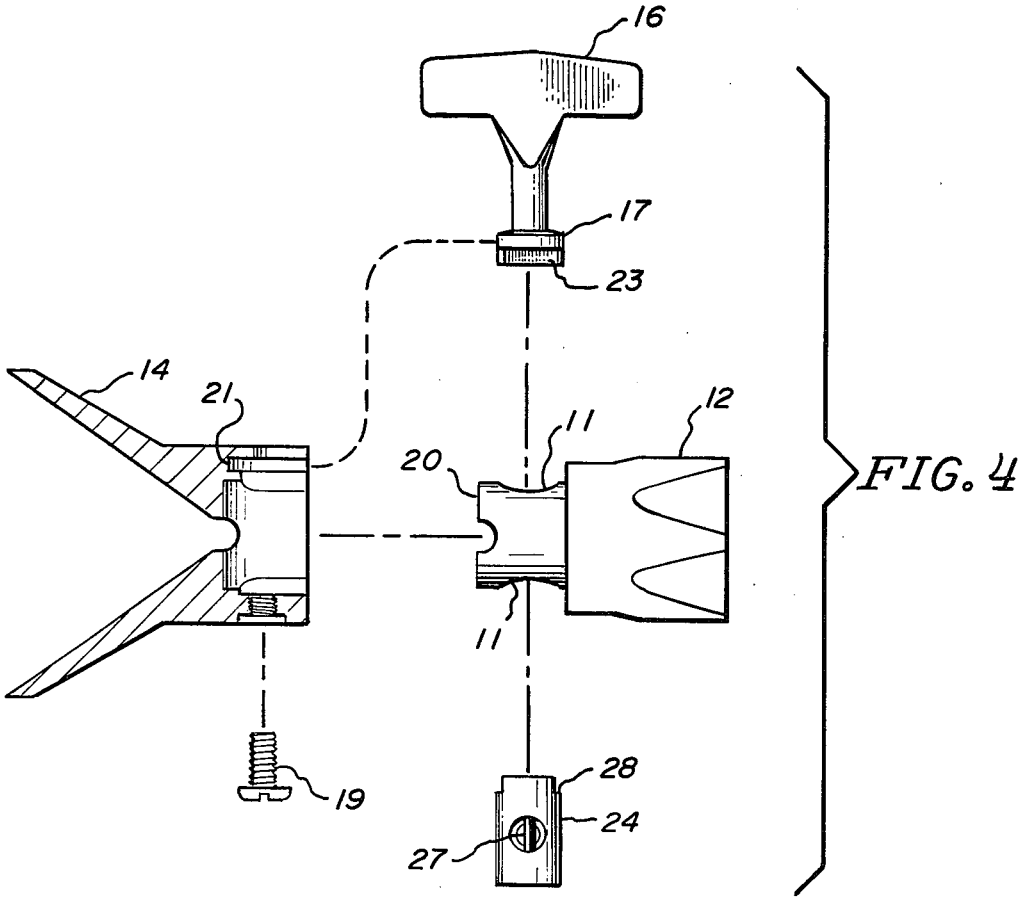
FIG. 4 shows a further exploded view of the components.

FIG. 4 is a further exploded view illustrating the assembly arrangement of certain components of nozzle 10. After tip nut 12 has been fitted over housing 20 and respective sealing members have been inserted therein, and cylindrical member 24 is inserted through the transverse passage 11 in housing 20, the projection 23 of handle 16 is fitted into groove 28 in the end surface of cylindrical member 24. Safety guard 14 is positioned against these components so as to bring shoulder 17 into slot 21, and bolt 19 is threaded into safety guard 14 and located within hole 30 in the end surface 31 of cylindrical member 24. The entire nozzle assembly 10 is then threaded onto spray gun body 15 by tightening tip nut 12.

In operation, handle 16 may be turned over the limited range of 180°. At one extreme rotational position, spray orifice 25 is directed forwardly between the respective ears of safety guard 14 for spraying liquid material through the spray nozzle. At the other extreme rotational position of handle 16 spray tip 25 is directed rearwardly and pin 27 is placed forwardly for cleaning purposes. In this position obstructions which may have accumulated in the narrow orifice in spray tip 25 are subjected to the full hydraulic fluid pressure and are usually expelled from the spray nozzle. Pin 27 serves to deflect the high pressure fluid discharging from the nozzle so as to break the otherwise concentrated fluid jet into a course spray.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A rotatable spray nozzle and safety guard for use in conjunction with spray guns and the like, comprising:

(a) a rotatable member having a passage therethrough and a spray orifice in said passage;

(b) a handle member removably keyed to said rotatable member, for rotating said rotatable member;

(c) a safety guard member attachable over said handle and rotatable member to hold said handle in operable keyed relationship to said rotatable member, whereby the removal of said safety guard member disables the operable keyed relationship between said handle and said rotatable member; and (d) means for fluid sealing said rotatable member against said spray gun.

2. The apparatus of claim 1, further comprising a housing attachable to said spray gun and having an opening therethrough for holding said rotatable member.

3. The apparatus of claim 2, wherein said means for fluid sealing further comprises a metallic member in said housing having a surface complementary shaped to said rotatable member surface shape in said housing and a resilient member between said metallic member and said spray gun.

4. The apparatus of claim 3, wherein said rotatable member further comprises a cylinder having a diametric passage therethrough and an end surface keyway and a second end surface locating hold.

5. The apparatus of claim 4, wherein said handle member further comprises a key at one of its ends fitted to said cylinder keyway, and a projecting shoulder adjacent said key.

6. The apparatus of claim 5, wherein said safety guard member further comprises a slotted opening for fitting over said handle projecting shoulder.

7. The apparatus of claim 6, further comprising a threaded hole through said safety guard member and alignable with said cylinder end surface locating hole, and a bolt for threading through said threaded hole.

8. The apparatus of claim 7, wherein said safety guard further comprises projecting ears diverging outwardly from said spray orifice.

9. A rotatable spray nozzle and safety guard for use in conjunction with spray guns and the like, comprising:

(a) a housing having a first axial passage therethrough and means for attaching said housing to a spray gun or the like with said axial passage in alignment with a spray gun liquid passage, said housing having a second passage therethrough in transverse alignment with said first passage;

(b) a cylindrical member sized for closely fitting into said second passage, said cylindrical member having a diametric passage therethrough and a spray tip secured therein, and having a locating hole in one end surface and a groove in the other end surface thereof;

(c) a handle member having a raised end for fitting into said cylindrical member end surface groove, and having a projecting shoulder adjacent said raised end;

(d) a safety guard having an open end formed for fitting over said handle member shoulder and said cylindrical member in said transverse housing passage, and including means for attaching thereto by projecting into said cylindrical member end surface locating hole, said safety guard further having a slot alignable over said handle member projecting shoulder; and (e) means, insertable in said housing first axial passage, for fluid sealing against said cylindrical member, thereby to prevent leakage from said housing first passage to said housing second passage.

10. The apparatus of claim 9, wherein said means for fluid sealing further comprises a metallic member having a first surface complementary-shaped to said cylindrical member, and having a passage therethrough, and having a second surface with a conical seat opening to said passage.

11. The apparatus of claim 10, wherein said means for fluid sealing further comprises a resilient sealing member having a passage therethrough and a first cone-shaped end for sealing against said metallic member conical seat, and having a second flange end for seating against said spray gun.

12. The apparatus of claim 11, wherein said safety guard further comprises a threaded hole alignable with said cylindrical member locating hole, and a bolt for threading into said holes.

13. The apparatus of claim 12, wherein said safety guard further comprises projecting ears diverging outwardly from said housing first axial passage.

14. A rotatable spray nozzle attachable to a spray gun for the spraying of pressurized liquids, comprising (a) a housing adapted for attachment to a spray gun, said housing having a passage therethrough for conveying pressurized liquids from the spray gun;

(b) a cylindrical member in said housing, said cylindrical member having a diametric passage therethrough in alignment with said housing passage;

(c) a spray orifice fixedly attached within said diametric passage;

(d) a metallic sealing member in said housing passage, said metallic sealing member having a first curved surface conforming to said cylindrical member and in contact therewith, and having an opposite surface with a conical flange entry point, and having a passage between said curved surface and said entry point; and (e) a resilient sealing member in said housing, having a neck terminating in a mating flange to said metallic sealing member conical flange entry point, and having a base adapted for clamping between said housing and said spray gun, said resilient sealing member having a liquid passage therethrough from said base to said neck.

15. The apparatus of claim 14, wherein said resilient sealing member neck is sufficiently long so as to project external of said housing passage.

16. The apparatus of claim 14, wherein said cylindrical member is constructed from metal having a hardness greater than said metallic sealing member.

17. The apparatus of claim 14, further comprising a pin fixed in said cylindrical member diametric passage.

18. The apparatus of claim 14, further comprising means for rotating said cylindrical member engageable against the end of said cylindrical member.

19. The apparatus of claim 18, further comprising a safety guard having divergent ears projecting forward from said orifice, said safety guard being attached to said housing.

20. The apparatus of claim 19, further comprising means for restraining said means for rotating said cylindrical member within said safety guard, whereby removal of said safety guard from said housing disengages said means for rotating.

* * * * *